US005789961A

United States Patent [19]

Bulsara et al.

[11] Patent Number: 5,789,961

[45] Date of Patent: Aug. 4, 1998

[54] NOISE- AND COUPLING-TUNED SIGNAL PROCESSOR WITH ARRAYS OF NONLINEAR DYNAMIC ELEMENTS

[75] Inventors: Adi R. Bulsara, San Diego, Calif.; William L. Ditto, Woodstock, Ga.; Mario E. Inchiosa, San Diego, Calif.; John F. Lindner, Wooster, Ohio; Brian K. Meadows, Fayetteville, Ga.

[73] Assignee: The United States of America as represented by the Secretary of the Navy, Washington, D.C.

[21] Appl. No.: 671,909

[22] Filed: Jun. 28, 1996

[51] Int. Cl.[6] ..... G06G 7/12

[52] U.S. Cl. ..... 327/355; 327/362; 327/363; 331/56

[58] Field of Search ..... 327/334, 355, 327/361, 363, 603, 339, 341, 362, 356, 358; 331/2, 78, 46, 56; 324/248

[56] References Cited

U.S. PATENT DOCUMENTS 5,574,369 11/1996 Hibbs ..... 324/248

OTHER PUBLICATIONS

Lindner et al., "Array Enhanced Stochastic Resonance and Spatiotemporal Synchronization", *Physical Review Letters*, vol. 75, No. 1, 3 Jul. 1995, pp. 3–6.

Moss, "Stochastic Resonance: A Signal + Noise in a Two State System", *Forty-fifth Annual Symposium on Frequency Control*, 1991, pp. 649–658.

Lindner et al., "Scaling laws for spatiotemporal synchronization and array enhanced stochastic resonance", *Physical Review E*, vol. 53, No. 3, Mar. 1996, pp. 2081–2086.

*Primary Examiner*—Kenneth B. Wells

*Attorney, Agent, or Firm*—Harvey Fendelman; Michael A. Kagan; Peter A. Lipovsky

[57] ABSTRACT

The invention exploits the phenomenon of stochastic resonance in a nonlinear dynamic system to enhance the system's response to a weak periodic signal locally corrupted by background noise. The invention is designed to enhance the signal-to-noise ratio (SNR) in the system's output power spectrum at the periodic signal's frequency. This technique utilizes an array of nonlinear dynamic elements whose individual outputs are specifically coupled to other array elements. The coupling is found to substantially enhance the output SNR over what would be expected from a signal processor based upon a single such element. This principle has the potential to substantially enhance the performance of arrays of nonlinear devices; in fact, the nonlinear array can be expected to yield an output SNR that is very close to that obtainable by an array of ideal linear devices, so that the coupling actually "linearizes" the nonlinear system. The output SNR enhancement is found to correlate with enhanced signal detection performance.

11 Claims, 7 Drawing Sheets

NOISE- AND COUPLING-TUNED SIGNAL PROCESSOR WITH ARRAYS OF NONLINEAR DYNAMIC ELEMENTS

STATEMENT OF GOVERNMENT INTEREST

The invention described herein may be manufactured and used by or for the Government of the United States of America for governmental purposes without the payment of any royalties thereon or therefor.

DOCUMENTS INCORPORATED BY REFERENCE

The following documents are hereby incorporated by reference into this specification: Linder, J. F., B. K. Meadows, W. L. Ditto, M. E. Inchiosa and A. R. Bulsara. July 1995. "Array Enhanced Stochastic Resonance and Spatiotemporal Synchronization." Physical Review Letters, vol. 75, no. 1, pp. 3–6; and Linder, J. F., B. K. Meadows, W. L. Ditto, M. E. Inchiosa and A. R. Bulsara. March 1996. "Scaling Laws for Spatiotemporal Synchronization and Array Enhanced Stochastic Resonance," Phys. Rev. E, vol. 53, no. 3, pp.2081–2086.

BACKGROUND OF THE INVENTION

This invention pertains broadly to the field of signal processing. More particularly, the invention pertains to a signal processor that exploits noise to respond to a signal of interest. In greater particularity, but without limitation thereto, the signal processor of the invention utilizes the phenomenon of stochastic resonance in a nonlinear dynamic system to enhance the system's response to a weak periodic signal locally corrupted by background noise.

Traditional signal processing has relied on various combinations of linear filters. These filters are realizable in both hardware and software versions and may include the use of numerical techniques such as the Fast Fourier Transform (FFT).

In conventional signal processing methods, noise, whether created naturally or intentionally, is usually considered a disruption or a hindrance to communication. This noise is usually eliminated or substantially reduced through filtering. As a result, an entire discipline known as linear filter theory has evolved in which tremendous efforts have been undertaken to eliminate or minimize the effects of noise.

Many important signal detection and signal estimation tasks require a linear representation of a signal in order to be accomplished optimally. High-fidelity signal transducers or sensors are therefore traditionally engineered to generate an output which is a linear, rather than nonlinear, function of their input. Unfortunately, requiring a sensor to respond linearly to its input may involve compromises such as reduced sensitivity, reduced dynamic range, reduced noise immunity, increased cost, and increased complexity.

A nonlinear filtering process known as stochastic resonance (SR) has been investigated in the physical and neural science areas. Stochastic resonance begins with a radical premise: that noise, either inherent or generated externally, can be used to enhance the flow of information through certain nonlinear systems.

Stochastic resonance is a nonlinear stochastic phenomenon which can effectively cause a transfer of energy from a random process (noise) to a periodic signal over a certain range of signal and system parameters. It has been observed in natural and physical systems and may be one means by which biological sensor systems amplify weak sensory signals for detection.

The stochastic resonance effect is an effect whereby the output SNR of a non-linear device or system can, for some range of input noise densities, be increased by increasing the level of noise input into the device or system. Therefore, if the input noise, whether inherent or otherwise unavoidable, falls within such a range, it may be advantageous to further increase the noise level until the device or system output reaches a maximum.

Stochastic resonance arises when noise can facilitate the response of a nonlinear device or system to its input signal. One example of such a device is a transducer which is bistable and is subject to an input signal that is too weak to cause the transducer to switch between its stable states. If such a switching could be provoked through the effect of noise, an enhancement of the device's response to an input signal could be realized.

SUMMARY OF THE INVENTION

The invention exploits the phenomenon of stochastic resonance in a nonlinear dynamic system to enhance the response of the system to a weak periodic signal locally corrupted by background noise. The invention is designed to enhance the signal-to-noise ratio (SNR) in the system's output power spectrum at the periodic signal's frequency. This technique utilizes an array or plurality of nonlinear dynamic elements whose individual outputs are specifically coupled to other array elements. The coupling is found to substantially enhance the output SNR over what would be expected from a signal processor based upon a single such element. This principle has the potential to substantially enhance the performance of arrays of nonlinear devices; in fact, the nonlinear array can be expected to yield an output SNR that is very close to that obtainable by an array of ideal linear devices, so that the coupling actually "linearizes" the nonlinear system. The output SNR enhancement is found to correlate with enhanced signal detection performance.

OBJECTS OF THE INVENTION

It is an object of this invention and to provide a signal processor in which noise is a feature to be utilized rather than to be suppressed.

Still a further object of this invention is to provide a signal processor that utilizes the phenomenon of stochastic resonance to enhance the detection or other processing of a signal of interest.

Yet a further object of this invention is exploit the phenomenon of stochastic resonance in a nonlinear dynamic system to enhance its response to a weak periodic signal locally corrupted by background noise.

Another object of the invention is to enhance the signal-to-noise ratio (SNR) of a signal processor's output power spectrum at the frequency of the signal being processed.

Another object of the invention is to enhance the signal capability a signal processor.

Still a further object of this invention is exploit the phenomenon of stochastic resonance in an array of nonlinear dynamic elements by adjusting noise and coupling strength to enhance the array's response to a weak periodic signal locally corrupted by background noise.

Yet a further object of this invention is to form an array of nonlinear transducers, which, when compared to a single transducer, exhibits one or more of the following benefits:

the array output is more nearly linear;

the output SNR of the array is higher;

noise inherent in the transducers is suppressed;

the array's sensitivity to the reception of weak signals is increased; and when the array is used in combination with a decision circuit for signal detection, signal detection statistics are improved.

Other objects, advantages and new features of the invention will become apparent from the following detailed description of the invention when considered in conjunction with the accompanying drawings.

DESCRIPTION OF THE PREFERRED EMBODIMENT

Figure 1A:
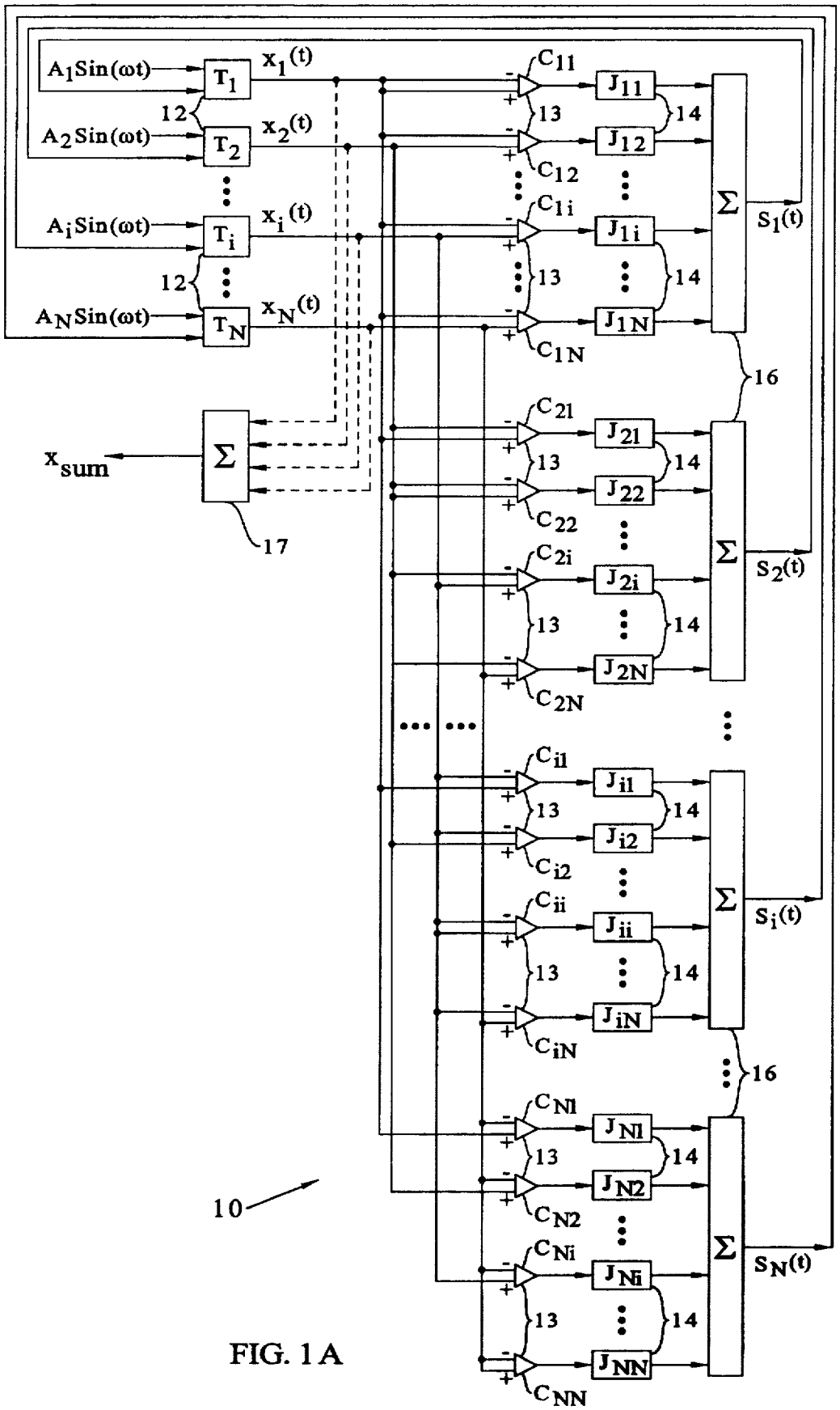
FIG. 1A is an analog representation of a coupled array of nonlinear dynamic elements.

According to one embodiment of the invention, an array or plurality of N nonlinear dynamic elements subject to a weak periodic signal locally corrupted by noise can be described as:

$$\frac{dx_n(t)}{dt} = g_n(x_n(t)) + \sum_{m=1}^{N} J_{nm}(x_m(t) - x_n(t)) + F_n(t) + A_n\sin(\omega t) \quad (1$$

where n,m $\epsilon$ {1,2,3, . . . ,N}, $\{x_n(t)\}$ are the nonlinear dynamic elements' state value time series, $\{g_n\}$ are functions describing element nonlinearity, $\{J_{nm}\}$ are linear or nonlinear functions, $\{F_n(t)\}$ are noise time series which are unique for each n, i.e. local noise, and $\{A_n\}$ are constants.

In this instance, $g_n(x_n(t))$ comprises a nonlinear signal component, $J_{nm}(x_m(t)-x_n(t))$ comprises an array coupling signal contribution to the system's elements, and $F_n(t)$ represents an individual element's internally generated noise component.

The signal of interest in this case is taken to be some periodic signal e.g. A' sin ($\omega$t). The array is disposed so as to be receptive to the signal of interest. The process of feeding this signal to each element within the array of elements may result in this signal being slightly attenuated, so each element may receive a signal of slightly different amplitude, this slightly attenuated signal being here designated as $A_n$ sin ($\omega$t).

The elements employed within the array may for example be very highly damped bistable oscillators, however other nonlinear elements which result in bistability or multistablity (more than two states) could be used. An example of such a highly damped bistable oscillator is a SQUID (Superconducting Quantum Interference Device) employed as a signal transducer. A bistable element in this instance will have two stable states. "Dynamic" elements are considered to be those elements whose state may evolve as a function of time. "Very highly damped" in this sense means that the oscillators essentially possess no second time derivative term or inertia in their dynamics.

The following particular case has been studied via computer simulations. The nonlinearity of the nth element is given by $g_n x = kx - k'x^3$. In general, "nonlinear" is meant to mean that the output or response of an element is not simply equal to its input multiplied by a constant factor (possibly zero) and/or having a constant (possibly zero) added to it.

The individual element's nonlinearity, in this case $g_n(x) = kx - k'x^3$, causes the element to be bistable. The periodic signal of interest plus the noise and coupling components, described above, causes the elements to switch back and forth between their two stable states. It is in this case that noise can enhance the element's response to a very weak periodic signal. Although the periodic signal on its own may be too weak to otherwise cause the elements to switch back and forth, the periodic signal in combination with the noise can cause such beneficial switching to take place, resulting in an enhanced output from elements at the periodic signal's frequency.

In an exemplary embodiment of the invention to be further described, optional comparators are utilized so that element "n" receives a signal formed by subtracting the "state value" ($x_n(t)$) of element "n" from that of element "m" ($x_m(t)$). Such a state value could take the form of voltage, current or other representation of the element's response to the signal of interest. Once this subtraction operation is performed, a linear or nonlinear coupling function 'J' is computed on the result of the subtraction.

The coupling function applied to the result of the subtraction may be a linear function, e.g. multiplication by a constant ($\epsilon$) or zero as in the present illustrated case, or a nonlinear function, e.g. the hyperbolic tangent, or odd powers.

In a case simulated, a linear function or factor was employed based upon what is described here as the "nearest neighbor" connectivity rule.

Under the "nearest neighbor" rule, the coupling feeding from the mth element into then nth is given by:

$$J_{nm}(x) = \begin{cases} \epsilon x & \text{if } |m-n| = 1, \\ 0 & \text{otherwise} \end{cases}$$

where $\epsilon$ is known as the coupling strength or coupling strength factor.

Though the choice of coupling connectivity may be the "nearest neighbor" case illustrated, in which an element "n" receives an output from those elements with an index of n+1 and n−1, connectivity could also be "global" coupling connectivity, in which case every element receives an output from every other element. Other choices of coupling connectivity may be used as well.

In the case simulated, the noise $F_n(t)$, local to the nth element a, is a realization of Gaussian delta-correlated (so-called "white") noise unique to that element. The noise is considered to have mean zero and power spectral density D. The amplitude of the periodic signal fed into the nth element is given by $A_n$=A.

Although in the test case the nonlinearities $\{g_n\}$ are taken to be identical for each element, the system would behave similarly even if the element nonlinearities are varied slightly from element to element, for example by roughly less than 10 per cent. The same applies for the coupling functions, noise densities, and periodic signal amplitudes.

Additionally, the noise need not be perfectly white or completely independent, and, as stated, element coupling connectivity could be introduced which links other than the "nearest neighbor" elements.

Figure 1B:
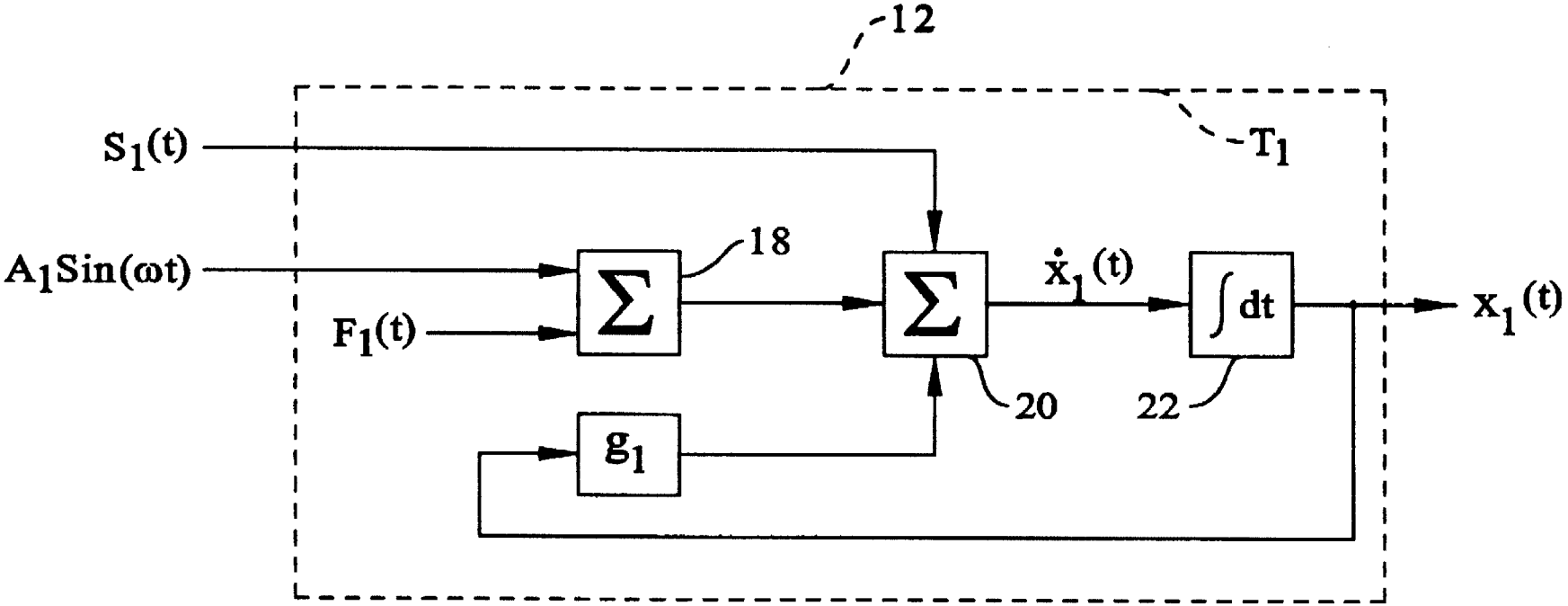
FIG. 1B is a detailed view of a single nonlinear dynamic element as may be used in the embodiment of the invention shown in FIG. 1A.

FIGS. 1A and 1B illustrate in block diagram format an example of how the invention can be realized via analog circuitry. One may use as the output of the system either the time series ($x_n(t)$) of a single element or, for better performance, the sum of the time series of two or more elements. We have simulated the cases where N was odd and either the time series of the $x_{(N+1)/2}(t)$ element or the sum of the times series of all elements was designated as the output.

Referring to FIG. 1A, a signal processor 10 is shown incorporating a representative array or plurality of (N) nonlinear dynamic elements 12 to be discussed in detail in FIG. 1B. In FIG. 1A, these elements are also represented by the symbol T for 1 through N elements. Each element 12 is shown connected to every other element 12 within processor 10 so that each element may receive a signal from every other element.

Comparators 13 function to enable comparison of the nonlinear dynamic elements' state values within array 10. In this sense, the comparator 13 designated as $C_{12}$ sums the output from element $T_2$ with the negative of the output of element $T_1$ which results in finding the difference between the outputs of elements $T_2$ and $T_1$. Element output differences are similarly found in all other comparators shown with the exception of comparators $C_{11}$ and $C_{22}$ etcetera.

In these latter comparators, like inputs are compared. The result of these comparator operations will be zero as differing elements are not in fact compared. Comparators $C_{11}$ and $C_{22}$ are illustrated to show simplicity in structural uniformity for illustrative purposes.

As can be seen in FIG. 1A, the result of the subtraction of the dynamic element state values performed by each comparator 13 is then output to its corresponding coupling function 14. Coupling functions 14 contain either the linear or nonlinear coupling function to be applied to the difference performed by comparators 13. Coupling function 14 also performs, in the embodiment illustrated, the nearest neighbor connectivity in which element "n" receives an output from those elements with an index of n+1 and n−1 according to the nearest neighbor rule earlier described:

$$J_{nm}(x) = \begin{cases} \epsilon x & \text{if } |m-n| = 1, \\ 0 & \text{otherwise} \end{cases}$$

where $\epsilon$ a linear multiplication factor identified herein as the coupling strength. In FIG. 1A, the coupling functions 14 have a first digit indicating the coupling function's destination element and a second digit indicating its source element. For example, coupling function $J_{ij}$ has an output going, albeit indirectly, to destination element $T_i$ and has an input received, albeit indirectly, from source element $T_j$.

The summers 16, indicated symbolically with a sigma, each serve to sum the outputs of coupling functions 14, desired to be input back to a particular element 12. For example, output summation $S_1$ is the sum of all element 12 outputs as compared in comparators $C_{11}$ through $C_{1N}$ and as appropriately operated on by coupling functions $J_{11}$ through $J_{1N}$. Similarly, summation $S_2$ is the summation of all element 12 outputs compared in comparators $C_{21}$ through $C_{2N}$ and as appropriately operated on by coupling functions $J_{21}$ through $J_{2N}$. As can be seen in FIG. 1A, each coupling summation output $S_n$ is provided to the nonlinear dynamic element $T_n$ and is generated by the taking of a coupling function of each of the output state value signals of the nonlinear dynamic elements, in which each output state value signal used to form said coupling summation signal is, prior to taking this coupling function, reduced by the output state value signal of the nonlinear dynamic element $T_n$ to which the coupling summation signal is provided. The outputs of the coupling functions so taken are then summed to generate $S_n$. The summation output is shown by the equation $$S_n = \sum_{m=1}^{N} J_{nm}(x_m(t) - x_n(t)).$$

According to the invention, the output of a single element, $x_n(t)$, or the sum (17) of the outputs of two or more elements of the plurality of very highly damped elements may be measured in response to the signal (A' sin ωt) and noise ($F_n(t)$). For communication or detection applications, the signal component A' sin ωt is the signal of interest. In FIG. 1B a representative nonlinear dynamic element is shown. This element is identified as $T_1$. As with all the elements 12 of FIG. 1A, a "coupling summation" input, in this case $S_1$, will be input to the element. In addition, the element is designed to receive the weak periodic signal ($A_1$ sin ωt), see FIG. 1B. What is meant by "weak" in this case is that $A_1$ is less than the signal amplitude necessary to cause the element to switch to a new state unaided by the effects of noise and/or coupling. Noise $F_1(t)$ in this example is generated "internally" within element 12.

The internally generated noise source $F_1(t)$ and the weak periodic signal source ($A_1$ sin ωt) are summed in a summer 18 and are then combined with coupling summation $S_1$, shown in equation form as $$S_1 = \sum_{m=1}^{N} J_{1m}(x_m(t) - x_1(t)),$$

and $g_1$ in a summer 20.

Internally generated noise source $F_1(t)$ may be noise generated as an unavoidable side effect of, for example, the electronic components of an element, or it may be purposely generated by some generic noise generator circuit within the element. Again, g represents an element's nonlinearity, in this case $g_1$, and is the nonlinearity having the index i=1. The output of summer 20 is then integrated in an integrator 22. The integrator output $x_1(t)$ comprises the state value of element $T_1$. Element output $x_1(t)$ is then forwarded to the appropriate comparators 13 as shown in FIG. 1A.

Output $x_1(t)$ shown in FIG. 1B, in one use of the invention, can be analyzed for communication or detection purposes.

If one numerically integrates (Eq. 1) and computes the power spectral density of the output chosen (whether this be the output of a single element or the sum of two or more elements) and from that the signal-to-noise ratio (SNR) at the periodic signal frequency, it is observed that, for a given array size N, there is a particular, optimal value of the noise density D and a particular, optimal value of the coupling strength $\epsilon$ at which the SNR attains its maximum value.

Figure 2:
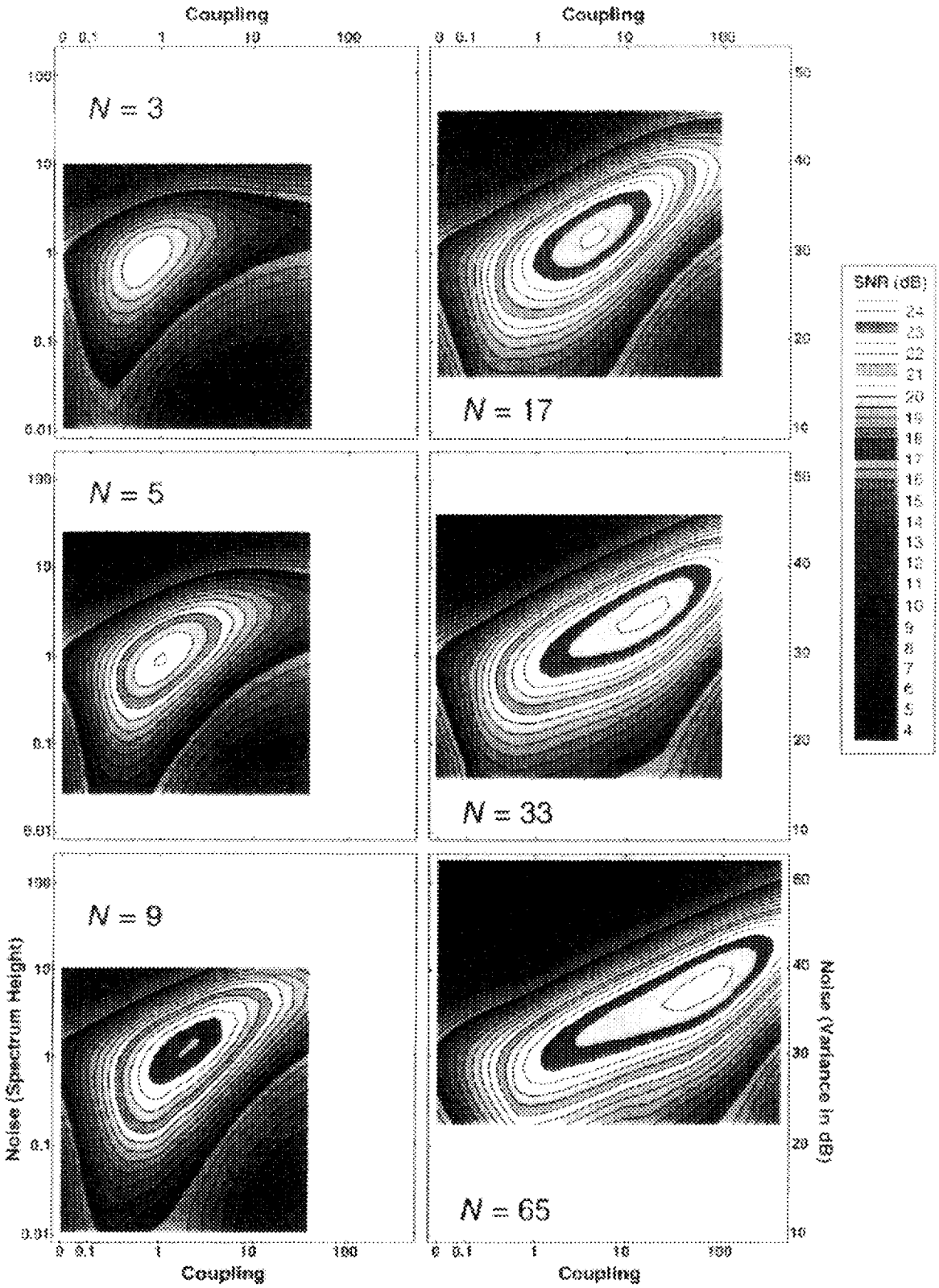
FIG. 2 graphically shows output SNR plotted against coupling strength versus noise.

FIG. 2 shows the output SNR computed from the time series of the (N+1)/2-th element in which contours of SNR are plotted against a "tuning space" of coupling versus noise. In the figure, noise (spectrum height) equals noise power spectral density (D). The operating parameters k=2.1078, k'=1.4706, A =1.3039 and f=ω/2π=0.116 were chosen for this computation but are not otherwise special. Values for epsilon are shown in this figure and are labelled simply as "coupling".

The circular or oval region near the center of each plot shows where the SNR attains its highest value (in terms of noise and coupling). "Tuning space" as used in the figure refers to adjusting the internal noise $F_n(t)$ and coupling strength ($\epsilon$) to maximize the output signal. The figure shows that the maximum output SNR is never achieved when the coupling strength is zero (in which case the output is identical to that of a single isolated element). Thus, the output SNR can always be increased over that of a single element via an array using an optimal, nonzero coupling value.

For the case where the time series of all the elements are summed to form the system's output, plots analogous to FIG. 2 again show that a nonzero coupling strength maximizes the output SNR.

Figure 3:
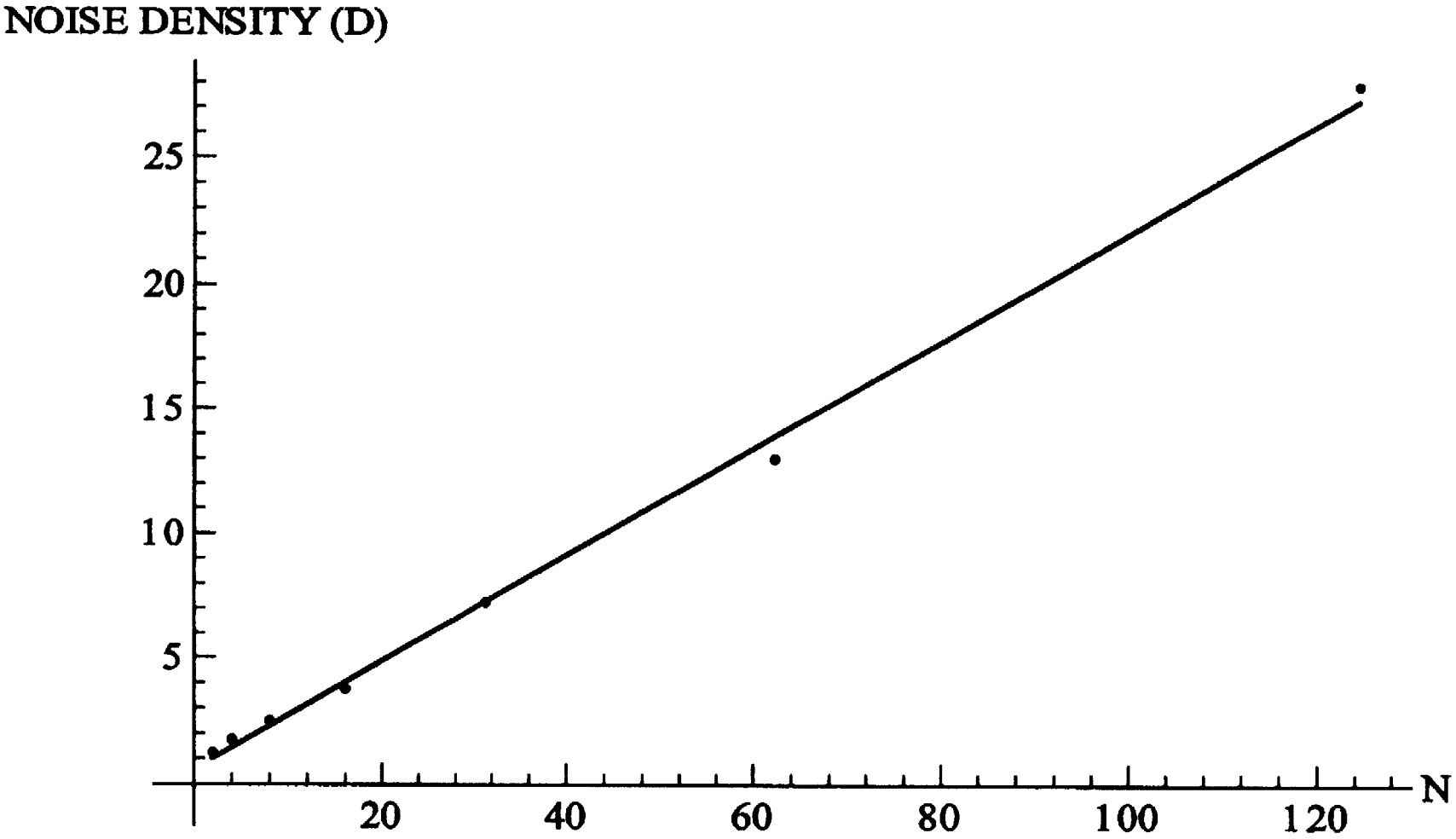
FIG. 3 illustrates optimal noise density versus N nonlinear dynamic elements.
Figure 4:
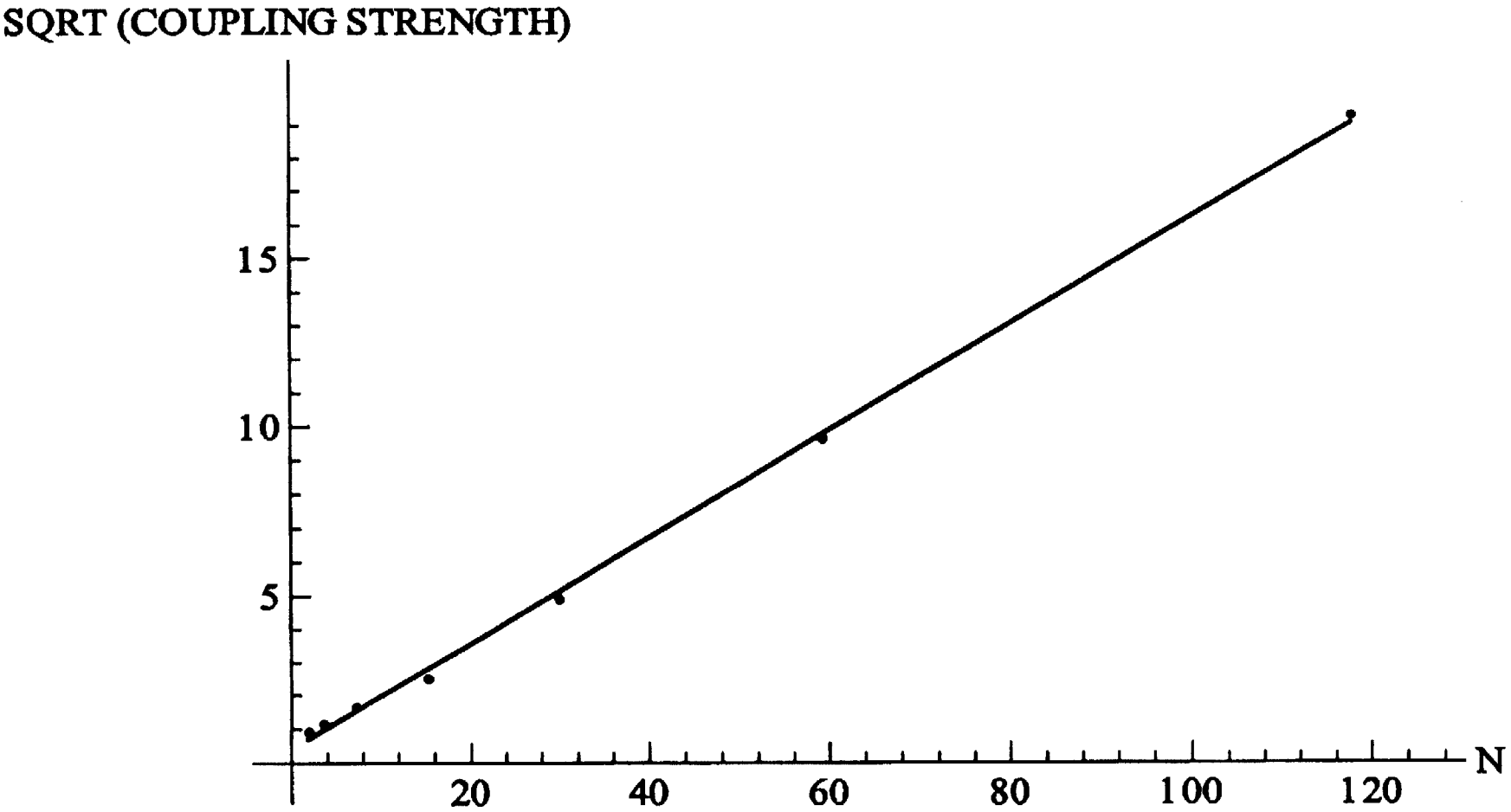
FIG. 4 illustrates optimal coupling strength versus N nonlinear dynamic elements.

Referring to FIGS. 3 and 4, relationships derived on the dependence on N of the optimal noise density D and coupling strength$\epsilon$, respectively are shown. In FIG. 3, the optimal noise density D is shown to be a linear function of N (a constant term plus a term proportional to N). In FIG. 4, the square root of the optimal value of coupling $\epsilon$ versus N is shown where it can be seen that the optimal coupling strength varies as a constant term plus a term proportional to $N^2$. Thus, if N is doubled, the optimal noise density will also be doubled, and the optimal coupling strength will be quadrupled (neglecting constant terms). These relations are approximate, but are quite accurate in practice.

Figure 5:
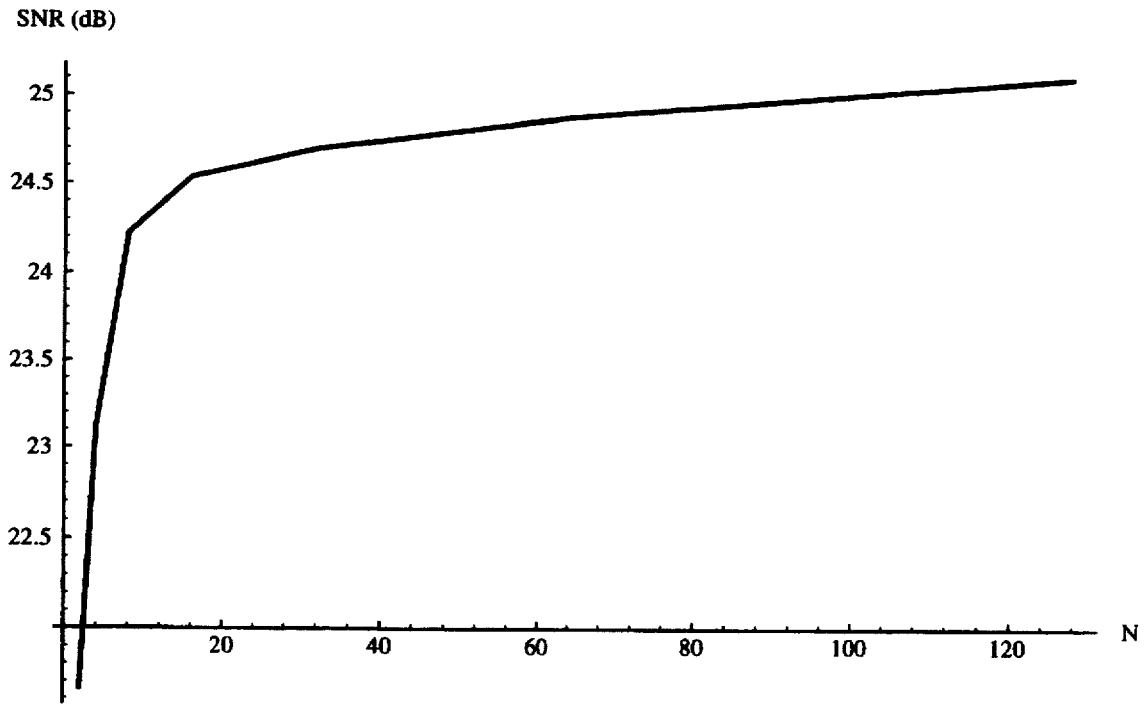
FIG. 5 illustrates maximum output SNR versus N nonlinear dynamic elements.

The maximum output SNR obtainable for a given N, using the optimal internal noise and coupling strengths, increases rapidly with N for small N and with diminishing returns for larger N as shown in FIG. 5. Therefore, most of the enhancement can be realized using a relatively small number of elements, say less than or equal to 32.

To perform signal detection, the array's output must be passed on to a decision circuit. FIG. 5, explained further below, was constructed using such a decision circuit. The decision circuit operates by computing the power spectrum of the array's output and comparing the power in a narrow frequency band of width $\Delta\omega=\omega/32$, centered at frequency $\omega$, to a threshold. If the power exceeds the threshold, the decision circuit concludes that a signal was present. A low threshold leads to high probability of detection and high probability of false alarm, while a high threshold leads to low probability of detection and low probability of false alarm. Plotting the probability of detection and probability of false alarm for a range of threshold values produces a receiver operating characteristic (ROC) curve.

Figure 6:
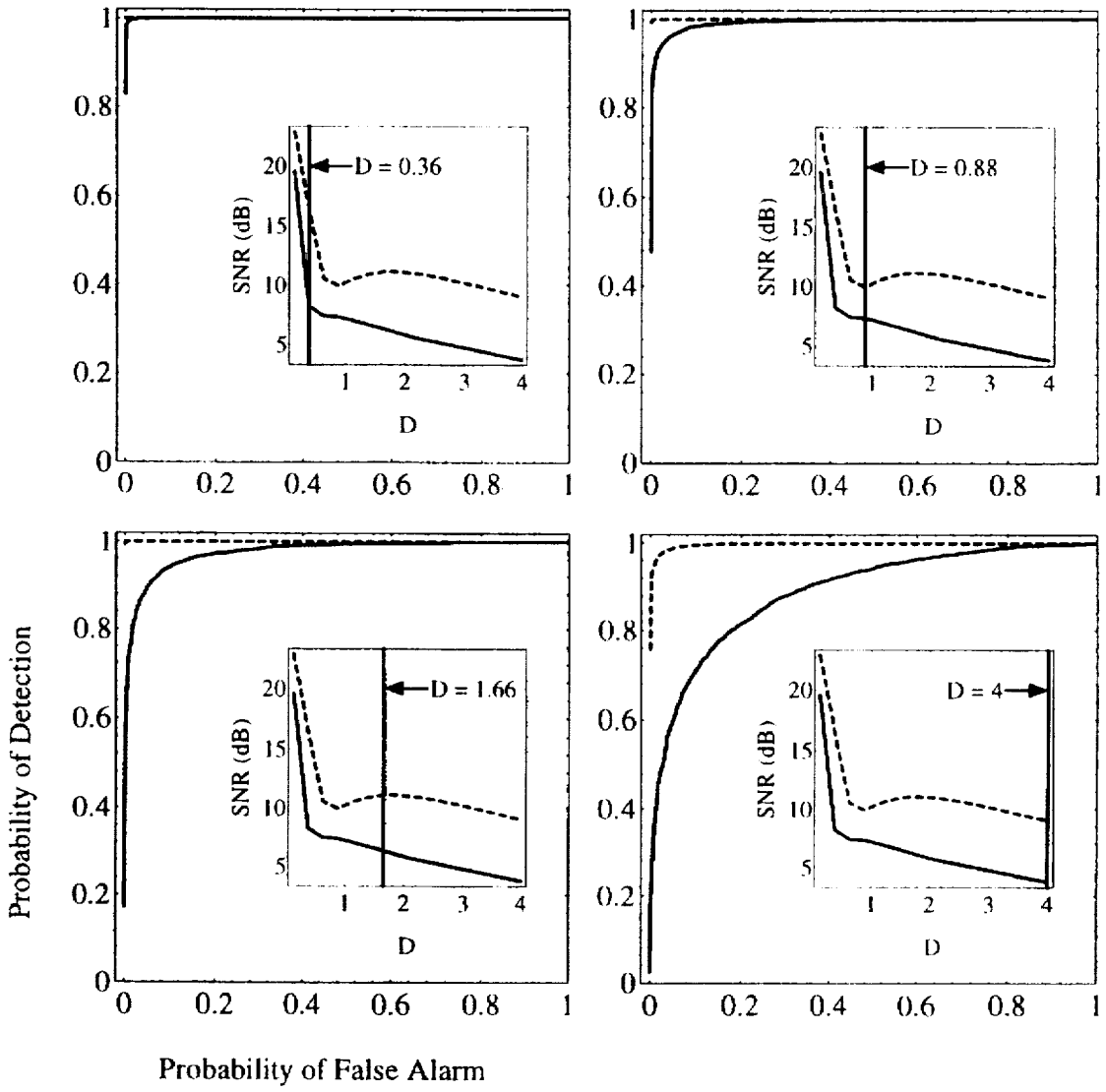
FIG. 6 contains four receiver operating characteristic (ROC) plots for different noise strength D.

Signal detection performance may be measured by way of such a (ROC) plot. The plot shows the detection system's probability of detection as a function of its probability of false alarm. Referring to FIG. 6, ROC curves which lie closer to the upper left-hand corner of the plot (high probability of detection, low probability of false alarm) indicate higher signal detection performance. FIG. 6 also shows that increases in the output SNR due to optimization of noise density D or use of a coupled array instead of a single element are reflected in increased signal detection performance. In this figure, the solid lines are for a single element, no coupling. The dashed lines are for an output element five of an array of nine elements that are "nearest neighbor" coupled. The insets show that the output SNR of the nine-element array is higher than that of a single element, and the ROC curves for the nine-element array, being closer to the upper left hand corner, indicate higher signal detection performance.

In the insets of FIG. 6, the SNR is shown to increase rapidly as the noise density D approaches zero. This is not due to switching between the element's two stable states, but rather it is due to small oscillations around one of the stable states. Further, although the SNR grows rapidly as D approaches zero, the amplitude of the element's output is much lower than it is for larger values of D, the larger values of D resulting in causing the switching between the element's stable states. The vertical line in each panel shown indicates the value of D used for the ROC's of that panel.

It is understood that the array elements become closely synchronized when the array output SNR is maximized. Measuring the synchronization as a function of noise density and coupling is thus a computationally efficient way of finding via numerical simulation the system parameters which optimize output SNR.

Such synchronization can be measured by using an "occupancy" function. We define state #1 to be the state which is favored when the periodic driving signal (A' sin ($\omega t$)) is at its maximum and state #2 to be the state which is favored when the driving signal is at its minimum. Then the occupancy equals the average of the percent of elements in state #1 when the periodic signal is at its maximum and the percent of elements in state #2 when the periodic signal is at its minimum. When this function is maximized, the output SNR will also be maximized.

The above-described technique exploits the nonlinear dynamic characteristics of the system described by (Eq. 1). Such a technique yields a number of specific advantages:

Coupling two or more nonlinear elements yields larger SNRs than one would obtain for a single isolated element.

The "nearest neighbor" linear coupling of two or more nonlinear elements experiencing locally generated noise can yield larger SNRs than one would obtain for a single isolated element.

Signal detection, measured in terms of probability of detection at a given probability of false alarm, increases in tandem with this SNR increase.

Summing two or more element time series to form the system output produces a higher SNR than that obtained without summing. Using summing and coupling together results in a higher output SNR than is obtainable using summing alone or coupling alone.

The optimal value of the noise density D varies linearly with the number of array elements N, and the optimal value of the coupling strength $\epsilon$ varies as $N^2$.

Noise can actually be used to enhance the performance of the system under certain circumstances. For extremely weak signals, adding carefully controlled amounts of noise locally at each element can increase the output SNR of the system and the system's signal detection performance. This effect does not occur in conventional signal processing.

Obviously, many modifications and variations of the invention are possible in light of the above teachings. It is therefore to be understood that the invention may be practiced otherwise than as has been specifically described.

What is claimed is:

1. A signal processing apparatus comprising:

a plurality of nonlinear dynamic elements in which each of said nonlinear dynamic elements is connected to receive a coupling summation signal which is derived from output state values of each of the other nonlinear dynamic elements and in which said nonlinear dynamic elements are disposed to be individually receptive to a signal of interest and further in which the output state value of each nonlinear dynamic element is generated from the sum of:

a signal derived from said signal of interest;

a noise signal component generated within the element;

a nonlinear response component generated within the element; and said coupling summation signal, said coupling summation signal being generated by taking a coupling function of each of said output state value signals of the nonlinear dynamic elements, in which each output state value signal used to form said coupling summation signal is, prior to taking said coupling function, reduced by the output state value signal of the nonlinear dynamic element to which said coupling summation signal is provided.

2. An apparatus according to claim 1 in which said coupling function provides nearest neighbor coupling between said nonlinear dynamic elements of said plurality of nonlinear dynamic elements.

3. The apparatus of claim 1 in which said coupling function provides global coupling between said nonlinear dynamic elements of said plurality of nonlinear dynamic elements.

4. An apparatus according to claim 2 in which said coupling function includes a coupling strength factor.

5. An apparatus according to claim 1 in which said nonlinear dynamic elements are bistable oscillators.

6. An apparatus according to claim 1 in which said nonlinear dynamic elements are electromagnetic transducers.

7. An apparatus according to claim 5 in which said bistable oscillators are SQUIDS.

8. A signal processing method comprising:

providing a plurality of nonlinear dynamic elements in which each of said nonlinear dynamic elements is connected to receive a coupling summation signal derived from output state values generated within each of the other nonlinear dynamic elements and in which said nonlinear dynamic elements are disposed to be individually receptive to a signal of interest and further in which the output state value of each nonlinear dynamic element is generated from the sum of:

a signal derived from said signal of interest;

a noise signal generated within the element;

a nonlinear response component generated within the element; and said coupling summation signal, said coupling summation signal being generated by taking a coupling function of each of said output state value signals of said nonlinear dynamic elements, in which each output state value signal used to form said coupling summation signal is, prior to taking said coupling function, reduced by the output state value signal of the nonlinear dynamic element to which said coupling summation signal is provided.

9. A method according to claim 8 in which said coupling function provides nearest neighbor coupling between said nonlinear dynamic elements of said plurality of nonlinear dynamic elements.

10. The method of claim 8 in which said coupling function provides global coupling between said nonlinear dynamic elements of said plurality of nonlinear dynamic elements.

11. A method according to claim 9 in which said coupling function includes a coupling strength factor.

* * * * *